US011932431B2

(12) United States Patent
Gerri

(10) Patent No.: US 11,932,431 B2
(45) Date of Patent: Mar. 19, 2024

(54) PACKAGING MACHINE FOR PACKAGING PAPER ROLLS

(71) Applicant: PLUSLINE S.R.L., Zola Predosa (IT)

(72) Inventor: Vittorio Gerri, Bologna (IT)

(73) Assignee: PLUSLINE S.R.L., Zola Predosa (IT)

( * ) Notice: Subject to any disclaimer, the term of this patent is extended or adjusted under 35 U.S.C. 154(b) by 217 days.

(21) Appl. No.: 17/627,336

(22) PCT Filed: Jul. 20, 2020

(86) PCT No.: PCT/IT2020/050180

§ 371 (c)(1),
(2) Date: Jan. 14, 2022

(87) PCT Pub. No.: WO2021/024282

PCT Pub. Date: Feb. 11, 2021

(65) Prior Publication Data

US 2022/0267040 A1 Aug. 25, 2022

(30) Foreign Application Priority Data

Aug. 2, 2019 (IT) ..... 102019000013770
Jan. 14, 2020 (IT) ..... 102020000000562

(51) Int. Cl.
*B65B 11/22* (2006.01)
*B65B 25/14* (2006.01)
(Continued)

(52) U.S. Cl.
CPC ..... *B65B 25/146* (2013.01); *B65B 11/22* (2013.01); *B65B 49/06* (2013.01); *B65B 49/10* (2013.01); *B65B 49/14* (2013.01); *B65B 59/001* (2019.05)

(58) Field of Classification Search
USPC ..... 53/396
See application file for complete search history.

(56) References Cited

U.S. PATENT DOCUMENTS 6,067,780 A 5/2000 Gentili et al.
6,228,273 B1 * 5/2001 Hammonds ..... B01F 31/85 210/205

(Continued)

FOREIGN PATENT DOCUMENTS

EP 0479498 A1 4/1992
WO 2010013267 A1 2/2010

OTHER PUBLICATIONS

International Search Report dated Jan. 15, 2020, in corresponding to International Application No. PCT/IT2020/050180; 3 pages.

(Continued)

*Primary Examiner* — Chinyere J Rushing-Tucker
(74) *Attorney, Agent, or Firm* — Maier & Maier, PLLC

(57) ABSTRACT

A machine for the packaging of paper rolls with a packaging sheet, including a station for the entry of the rolls to be packaged and the packaging sheet, folding elements for the upper and lower edges of each packaging sheet around the rolls to be packaged, lateral folding elements for folding the packaging sheet on the lateral ends, elements for the thermal welding of the packaging sheet at the folds, handling elements for moving the rolls along a predetermined direction, and an exit station for the packages, where the lateral folding elements include a plurality of independent lateral folding devices moved along two horizontal circuits and more lateral folding devices of a same circuit can be placed side by side.

13 Claims, 11 Drawing Sheets

(51) Int. Cl.

| | |
|---|---|
| ***B65B 49/06*** | (2006.01) |
| ***B65B 49/10*** | (2006.01) |
| ***B65B 49/14*** | (2006.01) |
| ***B65B 59/00*** | (2006.01) |

(56) References Cited

U.S. PATENT DOCUMENTS

| | | | | |
|---|---|---|---|---|
| 6,408,600 | B1 * | 6/2002 | Nankervis | B65B 51/30<br>53/477 |
| 2005/0132671 | A1 | 6/2005 | Cinotti | |

OTHER PUBLICATIONS

Written Opinion of the International Searching Authority dated Jan. 15, 2020, in corresponding to International Application No. PCT/IT2020/050180; 6 pages.

* cited by examiner

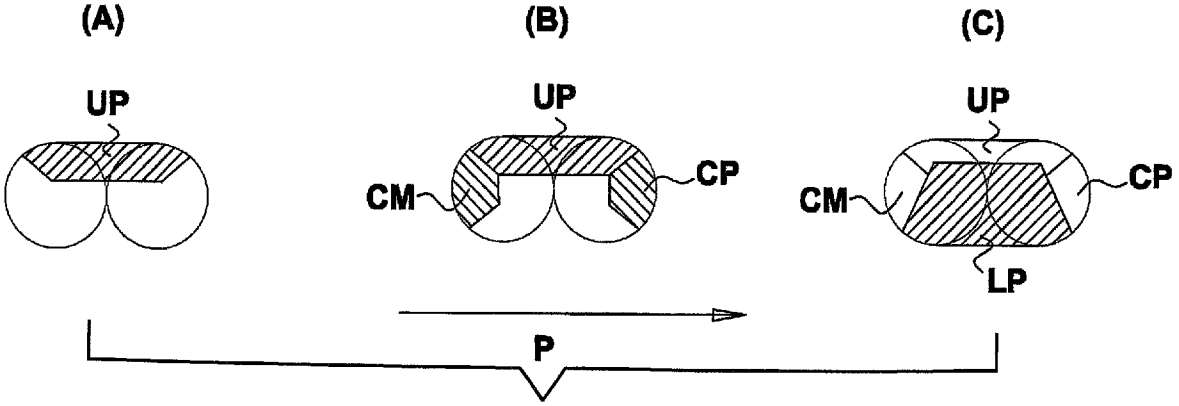
FIG.5
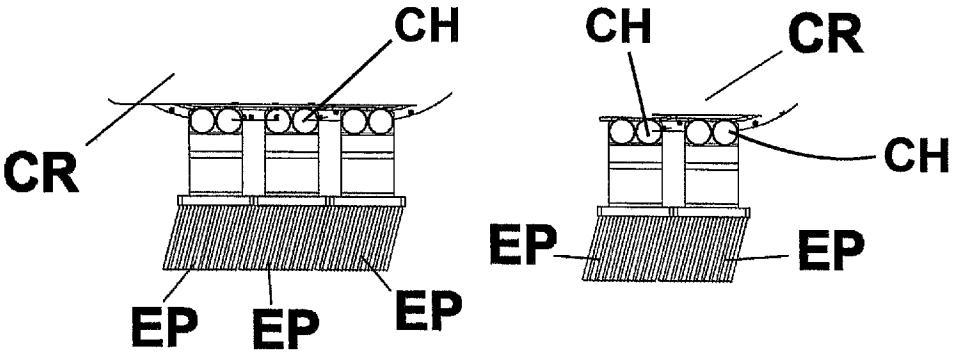
FIG.6
FIG.7

PACKAGING MACHINE FOR PACKAGING PAPER ROLLS

FIELD

The present invention relates to a machine for packaging products such as rolls of paper, for example toilet paper rolls or rolls of absorbent paper, using a packaging sheet, for example of plastic material, which wraps the rolls previously grouped and sorted into a predetermined packaging configuration.

BACKGROUND

It is known that the packaging of paper rolls by means of plastic packaging films requires the use of machines, commonly called packaging machines, equipped with an entry station for the rolls arranged according to a predefined grouping order, with one or more rows of rolls arranged side by side to form a layer or more superimposed layers of rolls. The rolls are introduced into said inlet station by means of an elevator, on which the groups of rolls to be packaged are previously formed. Before introducing the rolls into the packaging machine, a packing sheet is placed on the rolls arranged on the elevator. In a subsequent step of crossing the aforesaid entry station, the packaging sheet undergoes a first folding, wrapping the rolls upwards and laterally. Then, by means of two movable horizontal surfaces, commonly called folder and counter-folder, the folding of the edges of the packaging sheet protruding vertically at the sides of the package is caused, so that the sheet also wraps the rolls at the bottom. A sealing unit provides for the heat sealing of the edges of the sheet on the lower part of the package. Inside the packaging machine, the paper rolls are moved along a substantially straight path developed between the aforementioned entry station and an exit station for the completed packages. The handling of the packages being formed is carried out by means of a conveyor, commonly known as the "upper drive", specially configured to form a series of compartments in which the individual packages to be completed are received. Inside the packaging machine, further folds of the edges of the packaging sheet are also carried out. For this purpose, the packaging machine is equipped with a folding unit which acts on the heads of the package to be completed to create a so-called "head" folding oriented in the direction of movement imposed by the upper drive.

WO2010/013267 discloses a folding unit for packaging machines adapted to carry out the head folding of the packaging sheets used for the packaging of products such as toilet paper rolls and absorbent paper rolls, in which one or two folding elements are formed by brushes moved along the direction of movement of the packages to be completed with variable speed according to the position: in an initial phase of contact with the edges of the sheet to be folded, the folding elements are moved at a speed substantially equal to the speed imposed by the upper drive and, in a next step, the same folding elements are moved with greater speed, overcoming the package, to avoid the risk of unwanted creases or the risk that the folded edge of the sheet rises spontaneously. The folding elements of the group discloses in WO2010/013267 are connected with each other through a shaft which controls their movement in cooperation with a cam whose profile is selected in such a way as to achieve the aforementioned speed variation in a forward section whose direction coincides with that imposed by the upper drive. The use of two brushes makes it possible to have a brush ready to work on a new package introduced into the packaging machine when the other brush has left the previous package and moves along a return section of the circuit. A drawback of the system described in WO2010/013267 resides in the fact that said brushes can be at most two in number for a correct functioning of the system, although in WO2010/013267 reference is generally made to a greater number of folding elements, which negatively affects the production of the machine, limited by the number of folding elements always available.

SUMMARY

The main object of the present invention is to obviate the aforementioned drawback.

This result has been achieved, in accordance with the present invention, by adopting the idea of providing a machine having the characteristics indicated in claim 1. Other features of the present invention are the subject of the dependent claims.

Thanks to the present invention, it is possible to optimize the formation of the head folds of the packaging film according to the various package formats, always ensuring a correct stretching of the film for both the smaller and larger formats, since it is possible to form groups of mobile folding elements acting simultaneously on the same flap during the formation of the head folds without having to reconfigure the machine each time and thus ensuring greater flexibility of use of the machine itself. Furthermore, the structure of the folding elements and their control in accordance with the present invention allows to effectively use both sheets obtained from a film of plastic material and sheets of paper material.

BRIEF DESCRIPTION OF THE DRAWINGS

These and further advantages and characteristics of the present invention will be more and better evident to every person skilled in the art thanks to the following description and the attached drawings, provided by way of example but not to be considered in a limiting sense, in which:

FIGS. 5A-5C schematically show the folding steps of the head flaps of a package;

FIG. 6 represents a configuration of the folding elements (EP) of the machine shown in FIGS. 1-3 in the operating phase.

FIG. 7 represents a configuration of the folding elements (EP) of the machine shown in FIGS. 1-3 in the operating phase.

DETAILED DESCRIPTION OF THE EMBODIMENTS

Figure 1:
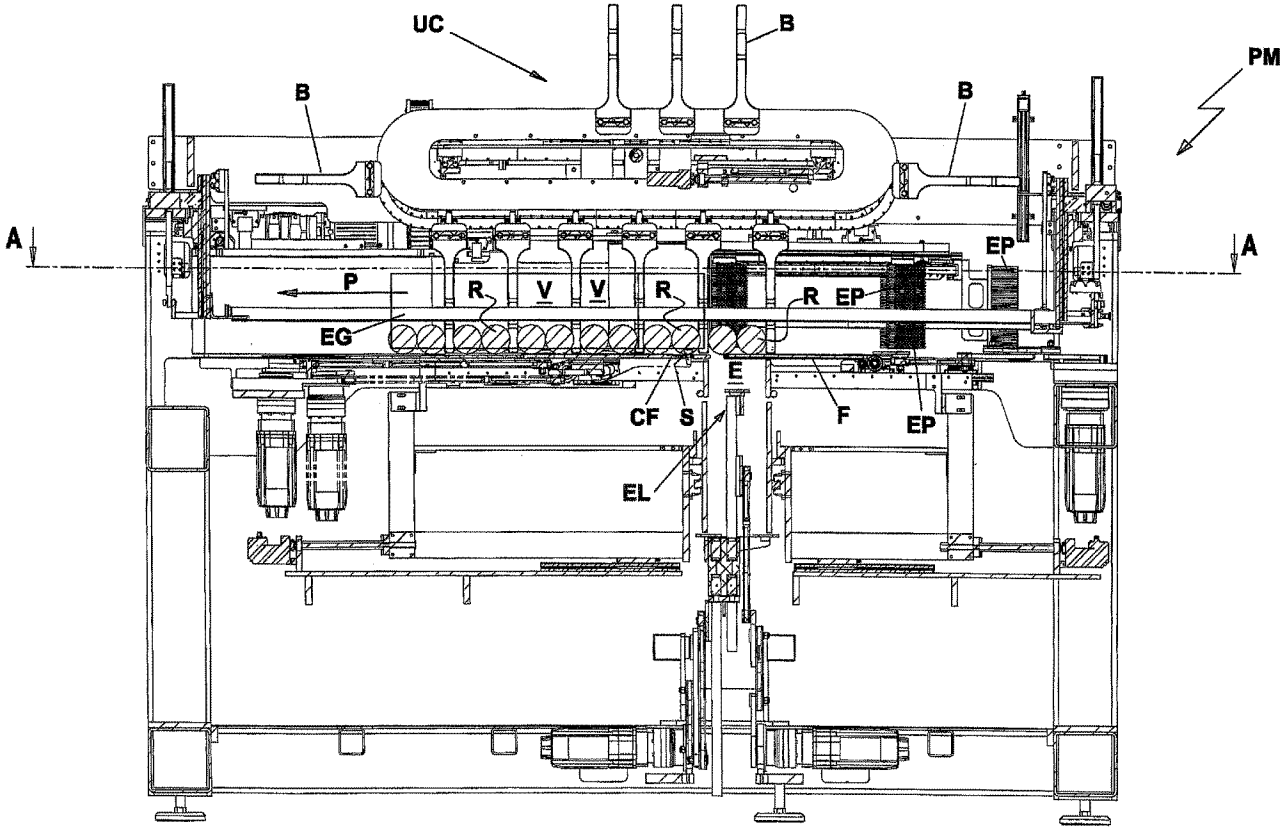
FIG. 1 represents a schematic side view of a machine according to the present invention.
Figure 2:
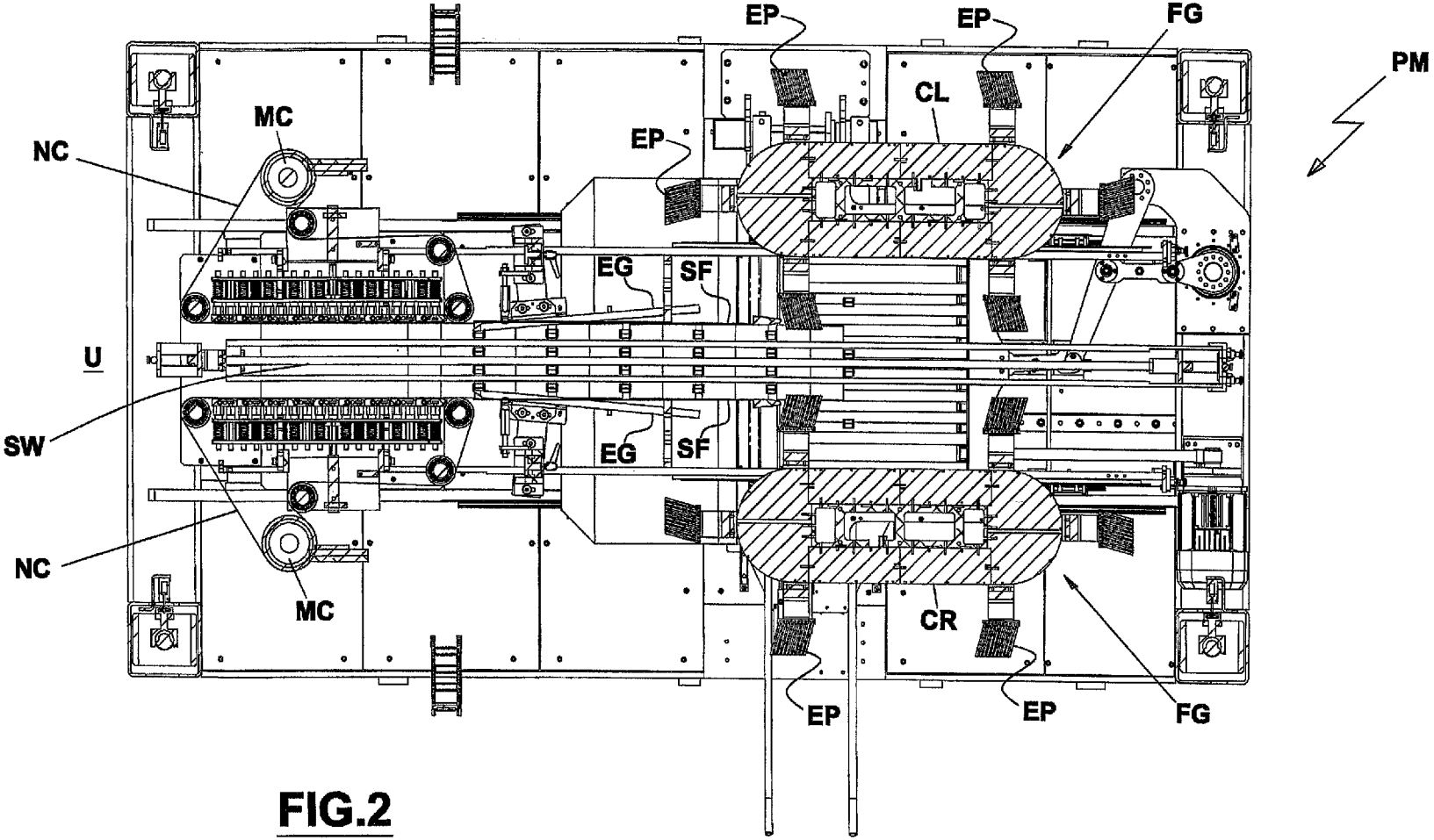
FIG. 2 represents a sectional view along the line A-A of FIG. 1.
Figure 3:
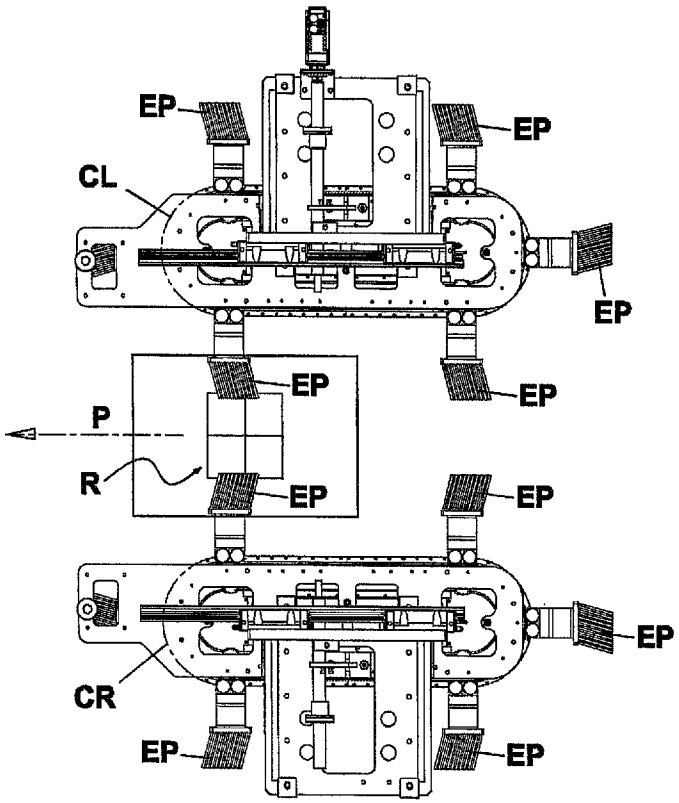
FIG. 3 represents a detail of FIG. 2.
Figure 4:
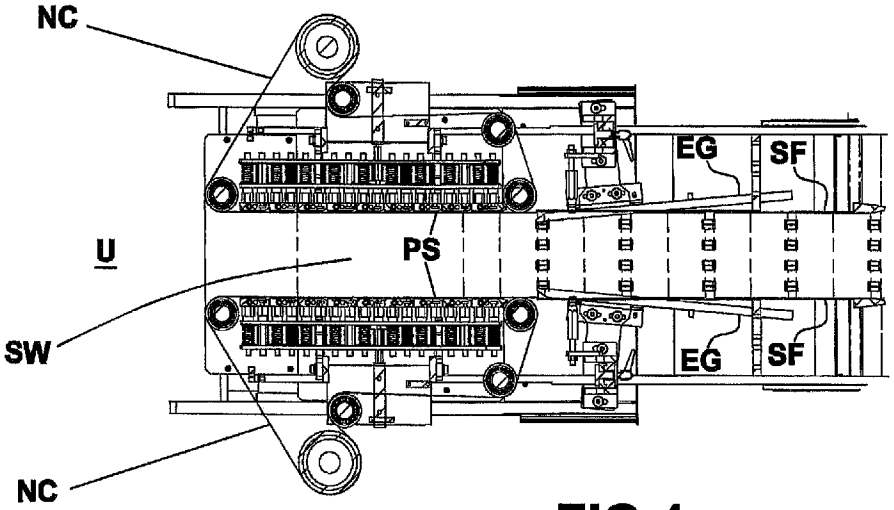
FIG. 4 represents another detail of FIG. 2.
Figure 8:
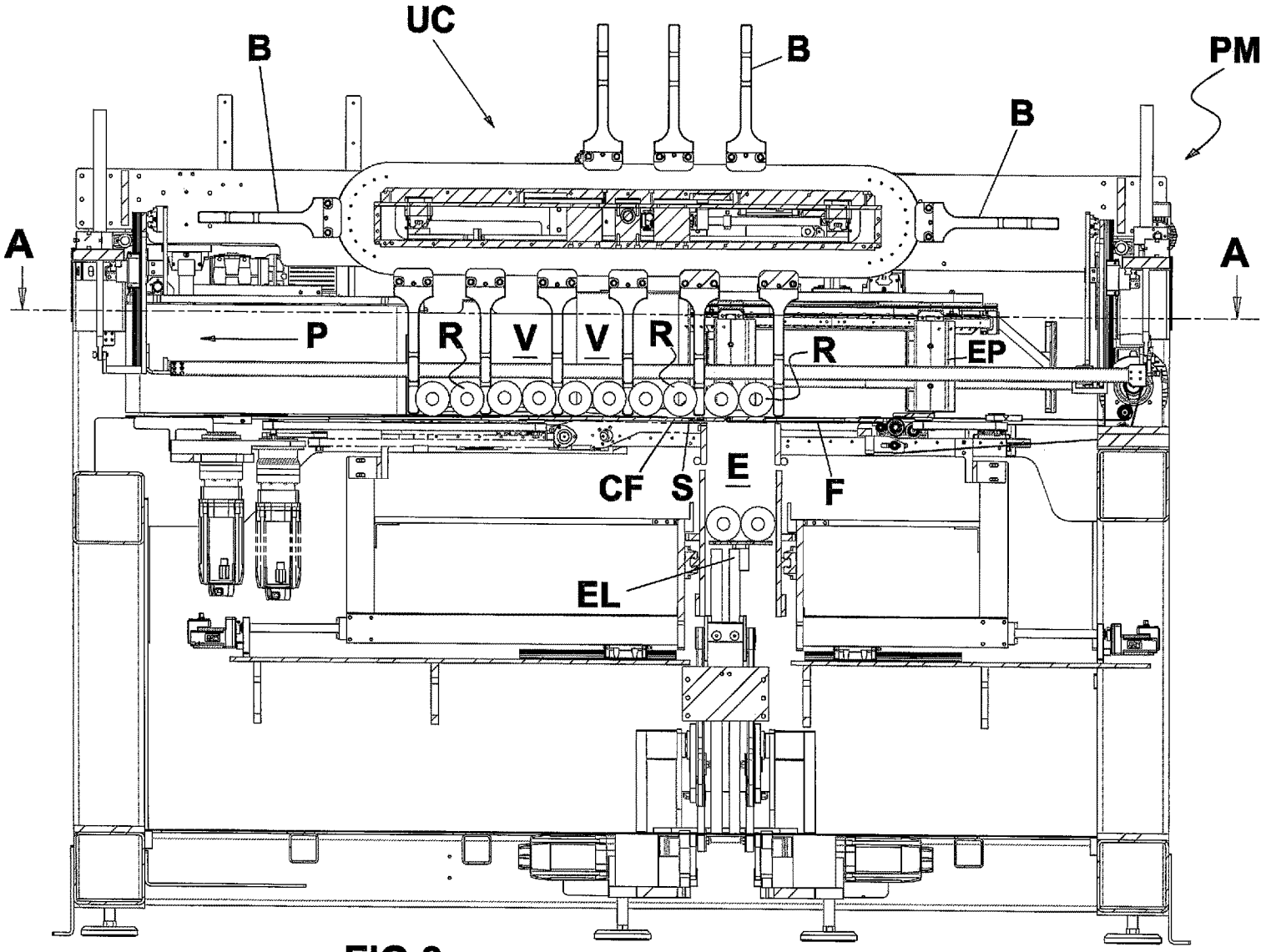
FIG. 8 is a schematic side view of a machine according to the present invention in which the folders (EP) have a different shape.
Figure 9:
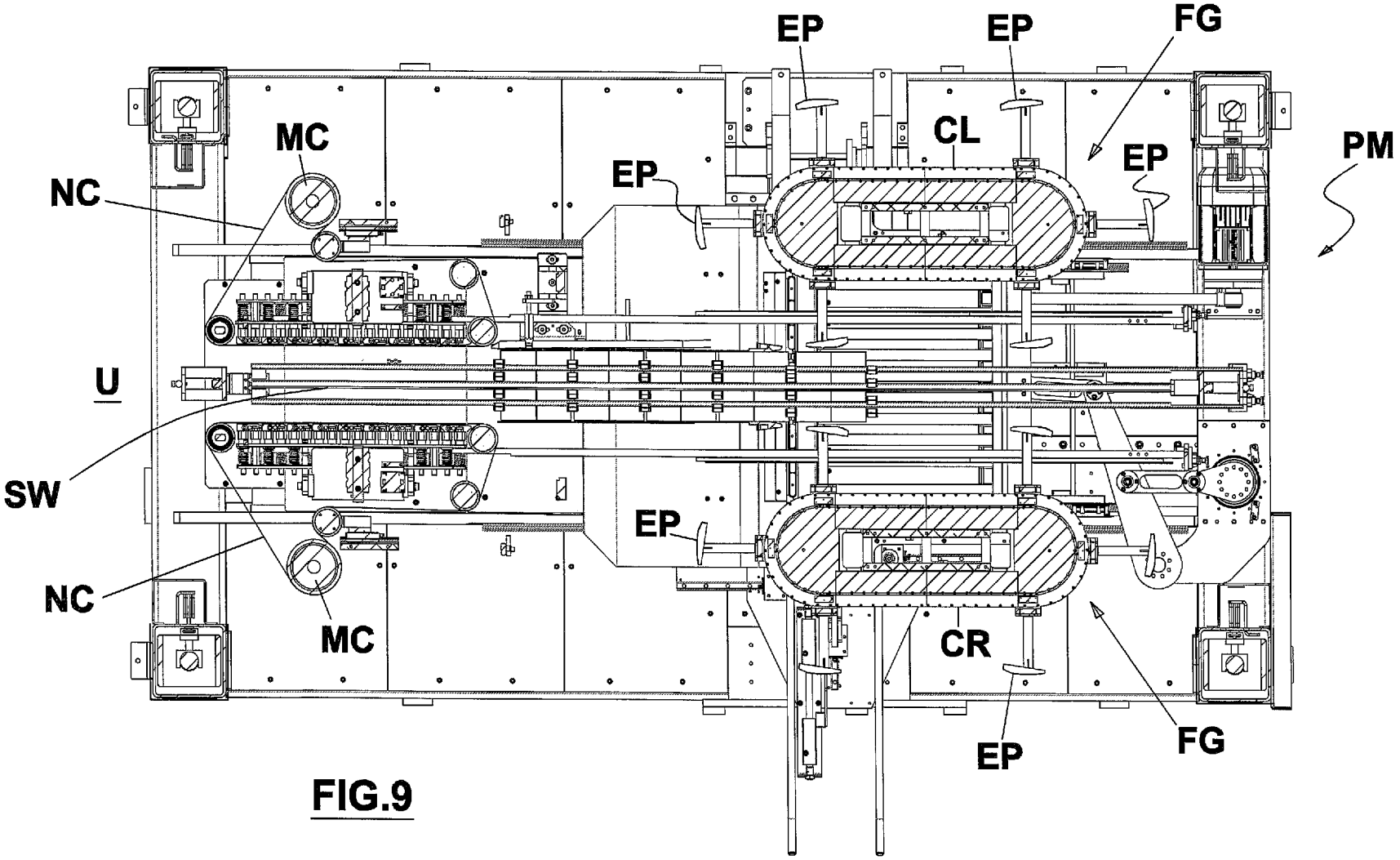
FIG. 9 is a schematic horizontal sectional view of the machine of FIG. 8.
Figure 10:
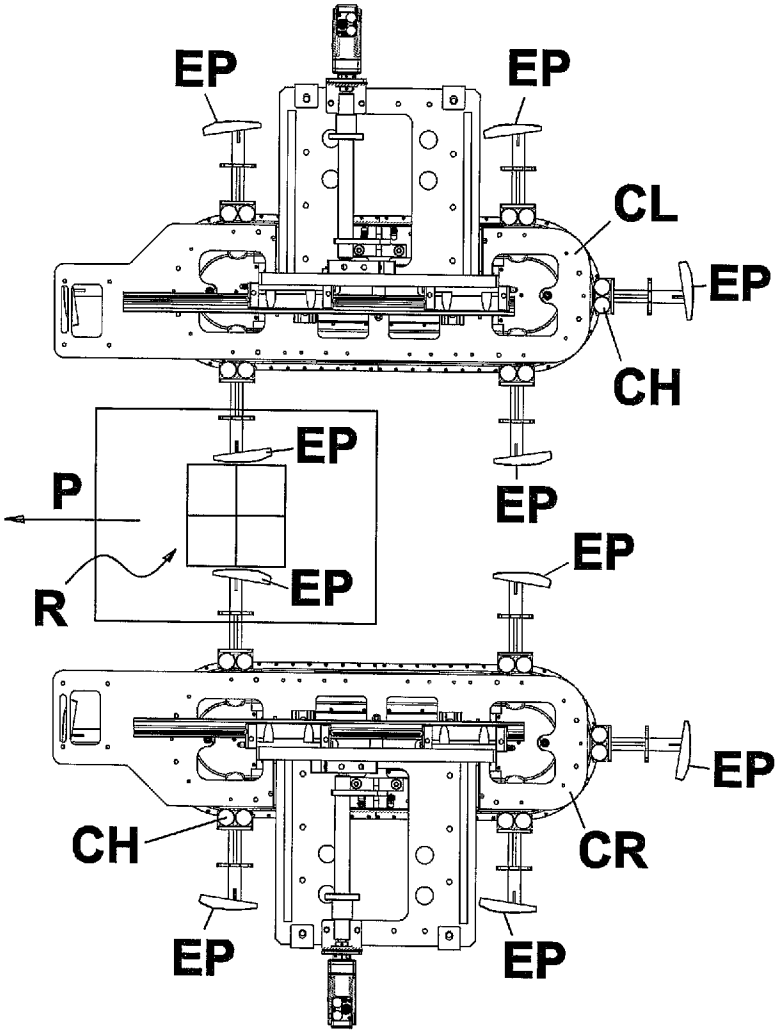
FIG. 10 is an enlarged detail of the machine shown in FIG. 9.
Figure 11:
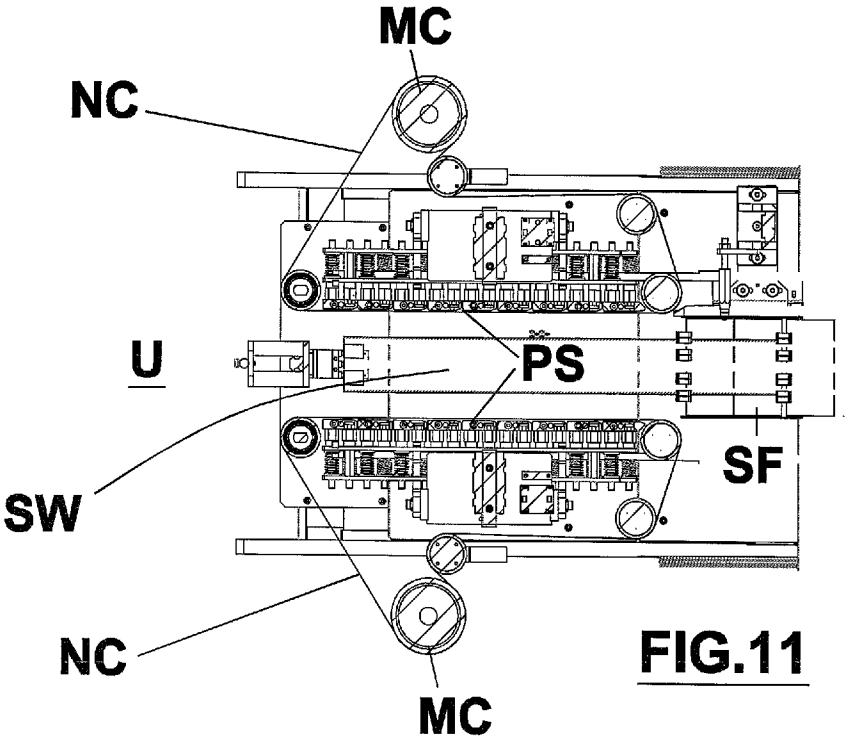
FIG. 11 is an enlarged detail of the machine shown in FIG. 9.
Figure 14:
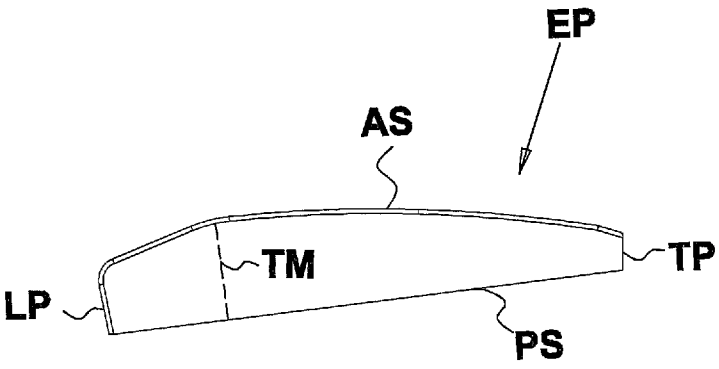
FIG. 14 is a detail relating to a folding element of the machine of FIG. 8 and FIG. 9.

Reduced to its essential structure and with reference to the example shown in the attached drawings, a packaging machine (PM) in accordance with the present invention is of the type comprising an entry station (E) for the rolls (R) arranged according to a predefined grouping order, with one or more rows of rolls arranged side by side so as to form a layer or more superimposed layers of rolls, and in which:

- the rolls (R) are introduced into said entry station by means of an elevator (EL), on which the groups of rolls to be packaged are previously formed;
- before introducing the rolls into the packaging machine, a packing sheet is placed on the rolls arranged on the elevator;
- in a subsequent step of crossing the aforesaid entry station, the packaging sheet undergoes a first folding, wrapping the rolls upwards and laterally;
- then, by means of two movable horizontal surfaces (F, CF), commonly called lower folder and lower counter-folder, the edges of the packaging sheet protruding vertically on the sides of the package are folded, so that the sheet wraps the rolls also on the underside;
- a sealing unit (S), preferably of the type integrated in the lower counter-folder (CF), provides for the heat sealing of the edges of the sheet on the lower side of the package;
- inside the packaging machine, the rolls to be packaged are moved along a substantially straight path (P), developed between the aforementioned entry station (E) and an exit station (U) for the finished packages, by means of a conveyor or "upper drive" (UC) comprising a plurality of blades (B) configured to form a series of compartments (V) in which the individual packages to be completed are received;
- inside the packaging machine, further folds of the edges of the packaging sheet are also carried out by means of a folding unit (FG) which acts on the two heads of the packages to be completed to provide a so-called "head" folding of the edges of the packaging sheet that result, in fact, in correspondence with the heads;
- a folding unit (FG) acts on the heads of the packages and comprises a plurality of movable side folders (EP) moved along two horizontal circuits (CR, CL) each of which has a forward section oriented in accordance with the direction (P) followed by packages inside the machine and a return section in the opposite direction;
- said circuits (CR, CL) are on opposite sides with respect to the center line of the machine (PM) and extend across the entry station (E);
- the movable side folders (EP) consist of bodies having a packaging sheet contact surface;
- downstream of the circuits (CR, CL) with respect to direction (P) there are, in order, a fixed lateral folding device (SF), a helical folding guide (EG) and a side welding station (SW);
- the lateral counter-folder (SF) consists of two substantially rectangular plates of predetermined height vertically positioned on opposite sides with respect to the center line of the machine (PM);
- the helical folding guide (EG) is formed by two helically shaped surfaces also located on opposite sides with respect to the centerline of the machine (PM);
- the side welding station (SW) is made up of two rows of electro-sealing plates (PS) placed on opposite sides with respect to the centerline of the machine (PM), with one internal side facing the path followed by the packages being completed, and by two belt conveyors (NC), preferably made of Teflon, driven by respective electric motors (MC), and closed in a loop so as to always have a section on the internal side of the respective row of plates (PS) directed in accordance with the aforementioned direction (P) of advancement of the packages in the machine (PM).

In accordance with an operating scheme known per se to those skilled in the art, when the elevator (EL) lifts the rolls (R) through the station (E), the packaging sheet is dragged upwards by the rolls themselves (R) and, thanks to the presence of two vertical walls that laterally delimit the elevator, wraps the rolls on their upper side and laterally. In this phase, above the station (E) there are two blades (B) which form a compartment (V) in which the rolls (R) and the upper and lateral edges of the packaging sheet are inserted. At the end of this phase, the side flaps of the packaging sheet protrude below the rolls (R). At this point, the station (E) is closed, by moving the folder (F) and the counter-folder (CF), and at the same time the blades (B) are moved in the direction (P). In this way, the folding of the protruding edges of the packaging sheet under the rolls (R), i.e. the lower folding of the packaging sheet, takes place and there is the translation of the package, not yet completed, in the direction (P) towards the outlet (U). Meanwhile, while the elevator is brought back to its starting height to receive other rolls intended for packaging, the edges of the packaging sheet previously folded under the rolls are welded (R).

FIG. 5A shows the upper flap (UP) of the packaging film folded downwards in the lifting phase, i.e. in the transit phase of the rolls through the entry station (E) of the machine (PM). FIG. 5B shows the flaps (CP) and (CM) folded towards the center of the head of the package by the lateral counter-folder (SF) and respectively by the mobile folders (EP) while the package is transported along the direction (P) by the upper drive (UC). FIG. 5C shows the lower flap (LP) of the packaging film folded upwards by the helical guide (EG). The flaps (CP) and (CM) surmount the flap (UP) and the flap (LP) surmounts the flaps (CP) and (CM). The package reaches the welding station (SW) with the head flaps (UP, CP, CM, CM) arranged as shown in FIG. 5C. The packages with the folded head flaps are guided by the upper drive (UC) to the side welding station (SW), where they are engaged by the belt conveyors (NC) which move them in front of the electro-sealing plates (PS) causing the sealing of the head flaps of the packaging film and, in this way, the definitive closure of the packages. The completed packages exit through the station (U) which corresponds to the outlet section of the side welding station (SW).

The general operating cycle described above concerns both the machine shown in FIGS. 1-4 and the machine shown in FIGS. 8-11 which differ in the shape of the movable side folders (EP).

In accordance with the example shown in FIGS. 1-7, the mobile side folders (EP) have an elastically deformable contact surface intended to come into contact with the packaging sheet. For example, the surface of contact with the packaging sheet consists of a brush, i.e. the movable side folders (EP) are shaped like brushes.

Figure 13:
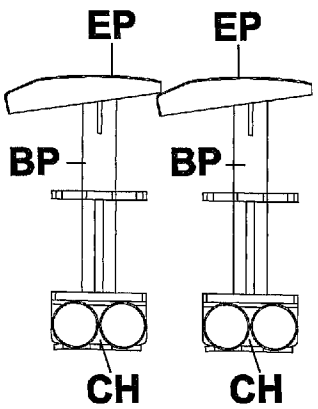
FIG. 13 shows a possible configuration of the folding elements (EP) of the machine shown in FIGS. 8-9 in the operating phase.
Figure 12:
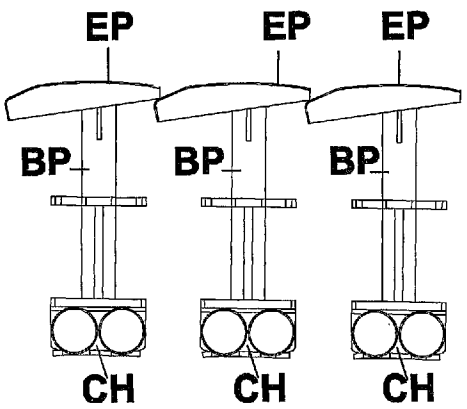
FIG. 12 shows a possible configuration of the folding elements (EP) of the machine shown in FIGS. 8-9 in the operating phase.

In accordance with the example shown in FIGS. 8-21, the mobile side folders (EP) have a rigid surface of contact with the packaging sheet as further described below. Advantageously, in accordance with the present invention, the circuits (CR, CL) are each formed by an annular track with linear motor (for example of the type commercially available under the name Beckhoff XTS series) on which the mobile side folders (EP) are mounted. In practice, the movement of each of the mobile side folders (EP) is independent from the movement of the other mobile side folders (EP). In other words, in accordance with the present invention, the mobile side folders (EP) are moved independently of each other along the respective circuits (CR, CL) being supported by independent carriages (CH) which are linked to the circuits (CR, CL) without being linked to one another. This allows, in particular, to group several mobile side folders (EP) acting simultaneously in the folding phase of the flap (CM) if the dimensions of the package to be made require it, always ensuring the correct accompaniment of this flap up to the lateral counter-folder (SF). By way of example, FIG. 6 and FIG. 12 show three movable side folders (EP) grouped, that is, next to each other, while FIG. 7 and FIG. 13 show two of them. Unlike traditional devices, the mobile side folders (EP) according to the present invention can be operated so as to intervene either individually, on the relative flap of the packaging film to be folded, or in groups composed of several folders acting simultaneously on said flap. This results in greater precision in the execution of the package and greater operational flexibility of the machine.

As previously mentioned, the mobile side folders (EP) can consist of brushes, or bodies whose contact surface with the packaging film is an elastic or rigid surface. For example, said contact surface can be a rigid corrugated surface.

In more general terms, a machine for packaging paper rolls (R) with a packaging film that wraps the rolls at the bottom, top and in correspondence with two side heads, in accordance with the present invention, comprises an entry station (E) for the rolls to be packaged and the entry of the packaging film, means for folding the upper and lower flaps of each packaging film around the rolls to be packaged, lateral folding means for folding the packaging film on the side heads, means for heat sealing the packaging film in correspondence with said folds, handling means (UC) for moving the rolls along a predetermined direction (P), and a pack exit station (U), wherein said lateral folding means comprise a plurality of independent lateral folders (EP) moved along two horizontal circuits (CR, CL) each of which has a forward section oriented along a direction (P) followed by the packages inside the machine and a return section in the opposite direction, in which said circuits (CR, CL) are on opposite sides with respect to the rolls to be packed, so that the handling of each mobile side folder (EP) of each circuit (CR, CL) is independent from the movement of the other folders (EP) of the same circuit and, depending on the packages to be made, a plurality of mobile side folders (EP) of the same circuit (CR, CL) can be placed side by side to form a contact surface with the packaging film whose extension along said direction (P) is defined by the number of movable side folders arranged side by side.

The mobile side folders (EP) can be made up of bodies suitably shaped to facilitate their progressive contact with the packaging film during their handling, in such a way as to create an even more correct folding of the packaging film to form the flap (CM).

In accordance with the example shown in FIGS. 8-21, each mobile side folder (EP) is connected to the respective carriage (CH) by means of a rigid connection arm (BP). Each movable side folder (EP) has a front surface (AS) of contact with the packaging sheet during the formation of the flap (CM) and an opposite rear surface (PS) facing the respective carriage (CH). Preferably, the front surface (AS) of the folders (EP) is convex, with the convexity facing outwards. Furthermore, preferably, the movable side folders (EP) of FIGS. 8-21 have a leading edge (LP) of reduced thickness with respect to the trailing edge (TP). Again, preferably, the movable side folders (EP) of FIGS. 8-21 have a maximum thickness (MT) greater than the thickness of the trailing edge (TP). And, more preferably, the maximum thickness (MT) of the movable side folders (EP) of FIGS. 8-21 is closer to the trailing edge than to the leading edge, so that it is in a rearward position. Consequently, the front surface (AS) of the movable side folders (EP) of FIGS. 8-21 is preferably an asymmetrical convex surface which has a greater longitudinal extension starting from the leading edge and smaller extension starting from the trailing edge of the folder.

The surface (AS) of the movable lateral folders (EP) of FIGS. 8-21 is smooth, i.e. it does not have ribs or corrugated parts.

The packaging sheet can be either of plastic or paper. It is therefore possible to create a machine for packaging of paper rolls (R) in which:

- the front surface (AS) of the mobile side folders (EP) is convex, with the convexity facing outwards; in which preferably, the side folders (EP) have a leading edge (LP) of reduced thickness with respect to the trailing edge (TP);
- preferably, the side folders (EP) have a maximum thickness (MT) greater than the thickness of the trailing edge (TP);
- more preferably, the maximum thickness (MT) of the side folders (EP) is closer to the trailing edge than to the leading edge, so that it is set back;
- the front surface (AS) of the folders (EP) is preferably an asymmetrical convex surface which has a greater longitudinal extension starting from the leading edge and smaller longitudinal extension starting from the trailing edge of the folder.

For example, the movement of the movable side folders (EP) described above can be controlled, along each of said circuits (CR, CL) as indicated below with reference to FIGS. 15-21 which illustrate the movement of the folders themselves on a side of the package to be formed, it being understood that the same movement takes place on the other side of the package itself. In the following description the terms "right" and "left" refer to the drawings for descriptive purposes only.

Figure 16:
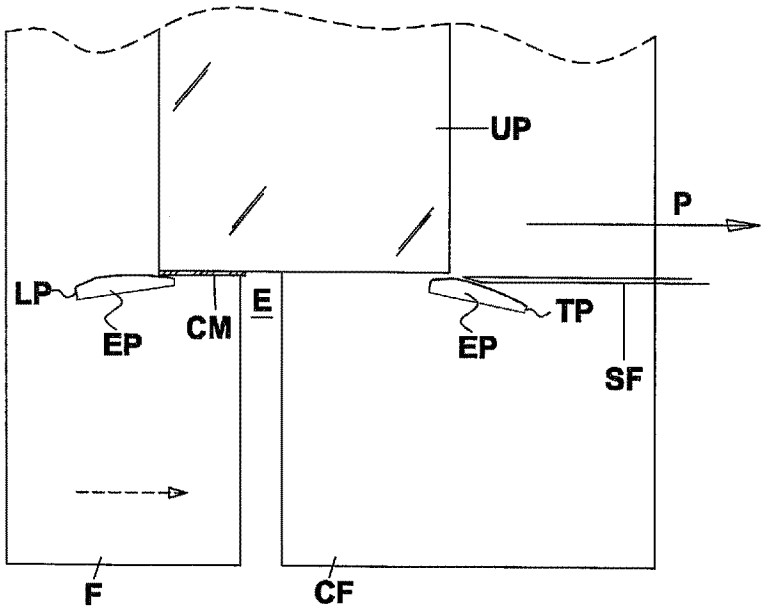
FIG. 16 represents one of a sequence of phases relating to the execution of a package in accordance with a possible method of controlling the folding elements of FIGS. 10-14.
Figure 15:
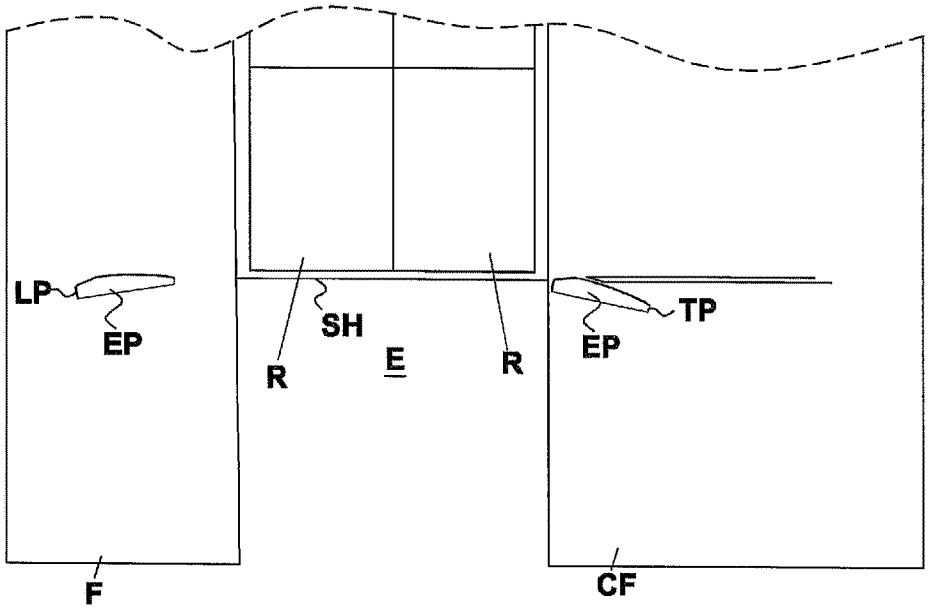
FIG. 15 represents one of a sequence of phases relating to the execution of a package in accordance with a possible method of controlling the folding elements of FIGS. 10-14.
Figure 19:
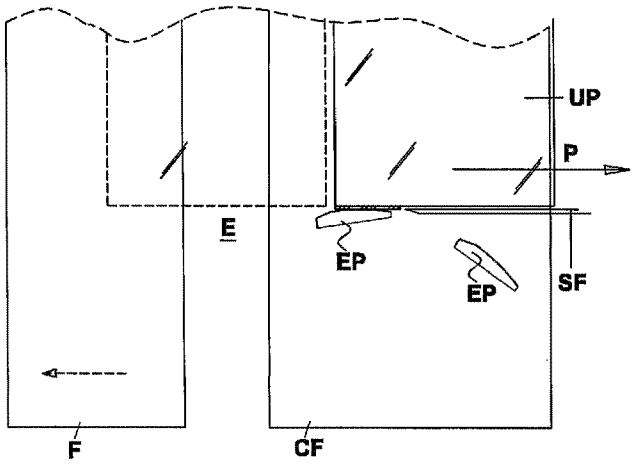
FIG. 19 represents one of a sequence of phases relating to the execution of a package in accordance with a possible method of controlling the folding elements of FIGS. 10-14.
Figure 18:
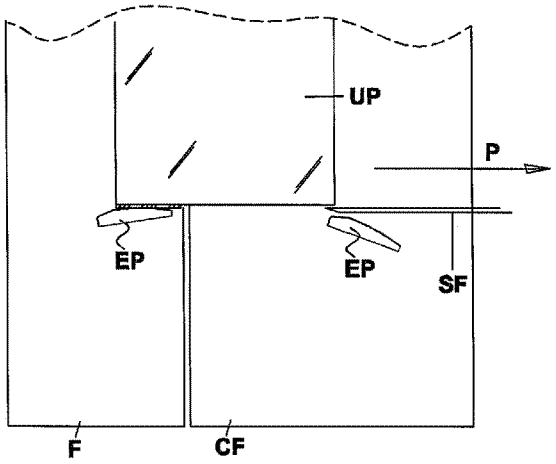
FIG. 18 represents one of a sequence of phases relating to the execution of a package in accordance with a possible method of controlling the folding elements of FIGS. 10-14.
Figure 17:
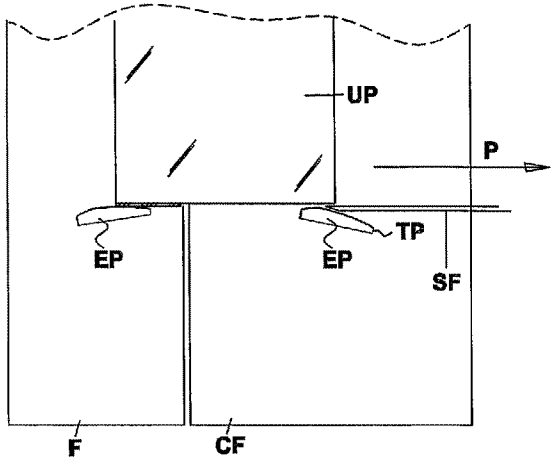
FIG. 17 represents one of a sequence of phases relating to the execution of a package in accordance with a possible method of controlling the folding elements of FIGS. 10-14.
Figure 21:
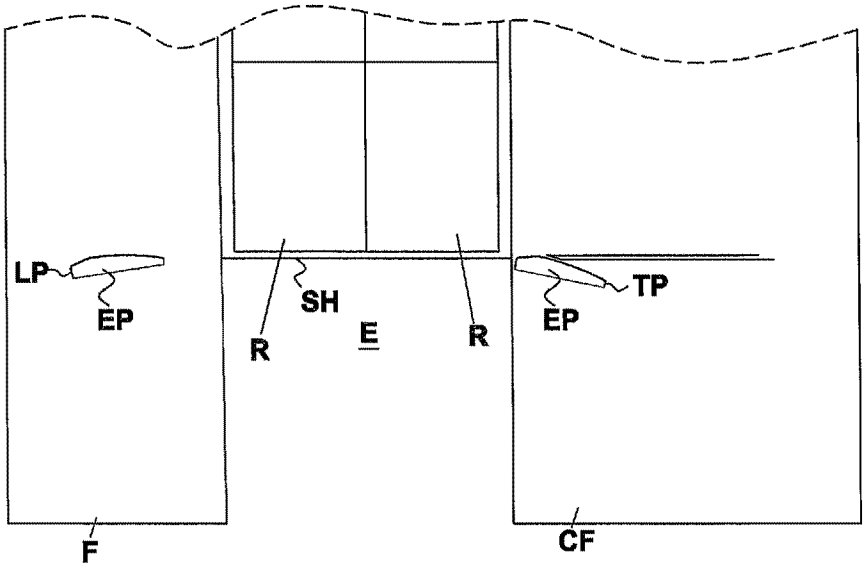
FIG. 21 represents one of a sequence of phases relating to the execution of a package in accordance with a possible method of controlling the folding elements of FIGS. 10-14.
Figure 20:
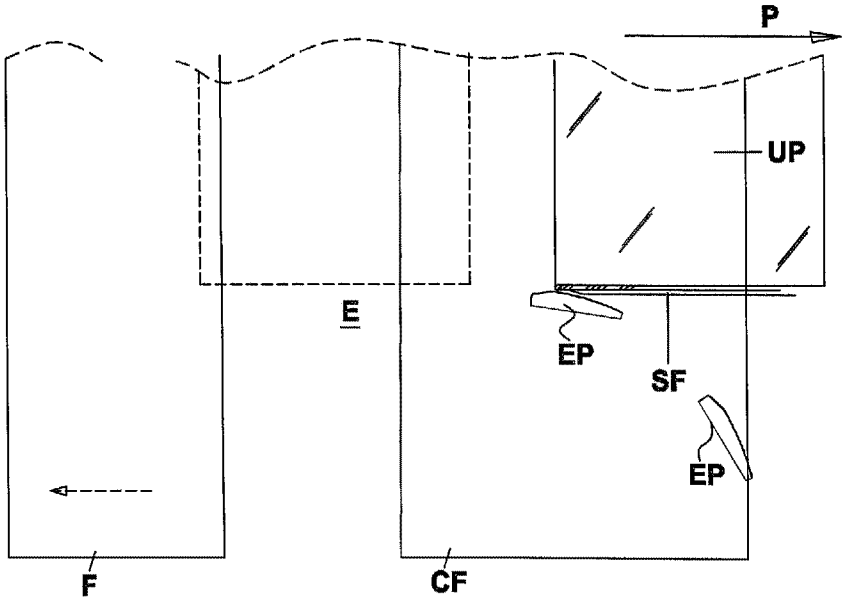
FIG. 20 represents one of a sequence of phases relating to the execution of a package in accordance with a possible method of controlling the folding elements of FIGS. 10-14.

FIG. 15 shows the lower folder (F) spaced from the lower counter-folder (CF), such that the rolls (R) present in the station (E) can be lifted by the elevator located below. FIG. 15 also shows, in transparency, the packaging sheet (SH) which is above the rolls (R). Furthermore, in FIG. 15 two side folders (EP) are shown, one to the left and one to the right of the station (E). As shown in FIG. 16 and FIG. 17, in a subsequent phase, when the elevator completely lifts the rolls (R), and the upper flap (UP) of the package is formed, the lower folder (F) and the lower counter-folder (CF) are approached, thus forming the lower flap of the package, while the mobile side folder (EP) on the right is stationary. In the subsequent movement to the right (direction "P") of the group formed by the rolls (R) and the packaging sheet (SH) which now wraps the rolls at the top and the bottom, the mobile side folder (EP) on the right forms the flap on the right of the respective head (reference "CP" in FIG. 5B) of the package in cooperation with the fixed lateral counter-folder (SF). The left side folder (EP) moves in accordance with the direction (P) of advancement of the package, determining the formation of the left flap (CM) of the package. FIG. 18 shows the mobile side folder (EP) on the left that accompanies the flap (CM) towards the left up to the fixed side counter-folder (SF), while the mobile side folder (EP) on the right moves away. FIGS. 19 and 20 show the lower mobile folder (F) again spaced from the lower counter-folder (CF) to allow the subsequent entry of another group of rolls to be packaged which in the meantime has been positioned on the elevator in the station (E). FIG. 19 and FIG. 20 also show that the mobile side folder (EP) on the left has accompanied the flap (CM) up to the fixed side counter-folder (SF) while the other folder (EP) continues its run away. FIG. 21 shows the same configuration shown in FIG. 15 to highlight the cyclical nature of the process described. In practice, a same mobile side folder (the left side folder EP in the previously described scheme) forms both flaps (CM, CP) on the heads of the package, always moving along the same direction, without reversing its motion. In other words, the front surface (AS) of each movable side folder (EP) is a surface maintained in contact with the packaging sheet to form two distinct folds (CM, CP) of the package while the movable side folder (EP) is moved unidirectionally along a section of the respective circuit (CR, CL) which extends for a predetermined length in correspondence of the entry station (E) for the rolls (R) to be packaged. Each of the movable side folders (EP) is capable of operating as described above. Although the drawings illustrate the case of two or three folders (EP) placed side by side to form said contact surface, the number of movable side folders (EP) that can be placed side by side can be different, also depending on the size of the individual side folders.

The packaging machine can be configured, as exemplified above, in such a way that said package handling means comprise a conveyor (UC) formed by a series of blades (B) which define a plurality of compartments (V) in each of which a package to be made is inserted, the said conveyor being arranged at a higher height than said folding means for the packaging film.

In the case in which the sheet (SH) is a sheet of paper material, it will be, according to a per se known technique, a sheet with one side coated with hot-activated glue so that the entry of the package into the heat sealing determines, as for the sheets obtained from plastic film, the definitive closure of the package.

Furthermore, the packaging machine can be configured, as exemplified above, in such a way that, downstream of said circuits (CR, CL) with respect to said direction (P), a fixed lateral counter-folder (SF), a helical bending guide (EG) and a side welding station (SW) are provided.

And, as exemplified above, said side sealing station (SW) can be of the type comprising two opposite rows of electro-sealing plates (PS), with one internal side facing the path followed by the packages being completed, and two belt conveyors (NC) closed in a loop so as to always have a section on the internal side of the respective row of plates (PS) directed along said direction (P).

In practice, the details of execution can in any case vary in an equivalent manner as regards the individual elements described and illustrated, without thereby departing from the scope of the solution adopted and therefore remaining within the limits of the protection granted to this patent in accordance with the following claims.

The invention claimed is:

1. Machine for the packaging of paper rolls with a packaging sheet which wraps the rolls inferiorly, superiorly and in correspondence of two lateral ends, comprising: a station for the entry of the rolls to be packaged and of the packaging sheet, folding means for the upper and lower edges of each packaging sheet around the rolls to be packaged, lateral folding means for folding the packaging sheet on the lateral ends, means for the thermal welding of the packaging sheet at the said folds, handling means for moving the rolls along a predetermined direction, and an exit station for the packages, wherein said lateral folding means comprise a plurality of independent lateral folding devices moved along two horizontal circuits each of which has a forward part along the direction followed by the packages inside the machine and a return part in the opposite direction, wherein said circuits are on opposite sides of the rolls to be packaged, such that the movement of each lateral folding device of each circuit is independent from the movement of the other folding devices of the same circuit and, depending on the packages to be made, more lateral folding devices of a same circuit can be placed side by side to form a contact surface with the packaging film whose extension along said direction is defined by the number of the folding elements arranged side by side.

2. Machine according to claim 1, said contact surface is formed by two folding devices arranged side by side.

3. Machine according to claim 1, wherein said contact surface is formed by three folding devices arranged side by side.

4. Machine according to claim 1, wherein said contact surface is an elastically deformable surface.

5. Machine according to claim 1, wherein said contact surface is a hard surface.

6. Machine according to claim 1, wherein said handling means of the packages comprises a conveyor formed by a series of blades which define a plurality of chambers in each of which a package to be produced is inserted, said conveyor being arranged above said means for folding the packaging sheet.

7. Machine according to claim 1, wherein downstream of said circuits with reference to said direction are arranged, in order, a fixed lateral counter-folding device, a helical folder and a lateral welding station.

8. Machine according to claim 7, wherein said lateral welding station comprises two opposite rows of electrowelding plates, with an inner side facing the path followed by the packages being completed, and two annular belt conveyors always having a part on the inner side of the respective row of plates moving along said direction.

9. Machine according to claim 1, wherein each lateral folding device has a front convex surface, said front surface being a surface that is kept into contact with the packaging sheet to form two different folds of the package while the lateral folding device is moved in a single direction along a section of the respective circuit that extends for a predetermined length in correspondence of said entry station.

10. Machine according to claim 9, wherein each lateral folding device is made by a body having a leading edge and a trailing edge with respect to the direction followed along the respective circuit, wherein the lateral folding devices have a leading edge whose thickness is smaller than the thickness of the trailing edge.

11. Machine according to claim 9, wherein the lateral folding devices have a maximum thickness that is higher than the thickness of the trailing edge.

12. Machine according to claim 9, wherein the maximum thickness of the lateral folding devices is closer to the trailing edge than the leading edge.

13. Machine according to claim 9, wherein said front surface of the lateral folding devices is an asymmetrical convex surface having a longitudinal extension that is higher starting from a corresponding leading edge and lower starting from a respective trailing edge of the folding device.

* * * * *